US008364057B2

(12) United States Patent
Niizuma

(10) Patent No.: US 8,364,057 B2
(45) Date of Patent: Jan. 29, 2013

(54) POST PROCESSING APPARATUS AND IMAGE FORMING SYSTEM USING THE SAME APPARATUS

(75) Inventor: Masato Niizuma, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 319 days.

(21) Appl. No.: 12/652,212

(22) Filed: Jan. 5, 2010

(65) Prior Publication Data

US 2010/0178093 A1 Jul. 15, 2010

(30) Foreign Application Priority Data

Jan. 13, 2009 (JP) ..... 2009-004435

(51) Int. Cl.
*G03G 15/00* (2006.01)

(52) U.S. Cl. ..... 399/107; 399/407

(58) Field of Classification Search ..... 399/107
See application file for complete search history.

(56) References Cited

U.S. PATENT DOCUMENTS 5,940,116 A * 8/1999 Park et al. ..... 347/263
6,231,039 B1 * 5/2001 Chung ..... 270/58.01
6,311,032 B1 * 10/2001 Carter et al. ..... 399/107
7,136,606 B2 * 11/2006 Rose et al. ..... 399/107
7,277,660 B2 * 10/2007 Umeyama et al. ..... 399/107
7,287,998 B2 10/2007 Masai
7,298,987 B2 * 11/2007 Tokishige et al. ..... 399/107
7,702,252 B2 * 4/2010 Maehata et al. ..... 399/107
7,821,681 B2 10/2010 Matsumoto
7,952,773 B2 * 5/2011 Ishizuka ..... 358/498
8,073,358 B2 * 12/2011 Ishii et al. ..... 399/107
2004/0208669 A1 * 10/2004 Tokishige et al. ..... 399/107

FOREIGN PATENT DOCUMENTS

JP 2002-128369 A 5/2002
JP 2005-189309 A 7/2005
JP 2006-313252 A 11/2006
JP 2008-070606 A 3/2008
JP 2008-141304 A 6/2008

OTHER PUBLICATIONS

Japanese Office Action dated Oct. 16, 2012 (and English translation thereof) in counterpart Japanese Application No. 2009-004435.

* cited by examiner

*Primary Examiner* — Anthony Nguyen
(74) *Attorney, Agent, or Firm* — Holtz, Holtz, Goodman & Chick, PC

(57) ABSTRACT

A post processing apparatus, placed on a floor, and placed next to a downstream side of an image forming apparatus also placed on the floor in a sheet conveyance direction, to perform a post processing operation onto sheets ejected from the image forming apparatus, including a plurality of joining sections to join the image forming apparatus, wherein the plurality of the joining sections include an elastic member.

4 Claims, 5 Drawing Sheets

POST PROCESSING APPARATUS AND IMAGE FORMING SYSTEM USING THE SAME APPARATUS

CROSS REFERENCE TO RELATED APPLICATION

This application is based on Japanese Patent Application No. 2009-004435 filed on Jan. 13, 2009, with the Japanese Patent Office, the entire content of which is hereby incorporated by reference.

TECHNICAL FIELD

The present invention relates to a post processing apparatus which conducts a post processing process onto a recording sheet, and an image forming system which includes the post processing apparatus, and an image forming apparatus which forms an image on the recording sheet, and conveys the recording sheet carrying the formed image to the post processing apparatus.

BACKGROUND OF THE INVENTION

In recent years, various post processing apparatuses have been developed, which conduct various post processing processes, such as a hole-punching process, a sheet-folding process, and a sheet-binding process, onto sheets which carries images formed by an image forming apparatus, such as an electro-photographic copying device, a printing device, a facsimile device, or a compound-machine having the functions of the above devices. Further, image forming systems, in which the post processing apparatus and the image forming apparatus are electrically combined, are generally used as the image forming systems.

In order to exactly conduct delivery and receipt operations of the recording sheet, ejected from the image forming apparatus, it is necessary for the post processing apparatus and the image forming apparatus to be accurately positioned in relationship with each other. For determining the positional relationships between them, they are combined by screws at their combining sections (see Unexamined Japanese Patent Application Publication No. 2002-128369). According to said Patent Document, the combining section of the post processing apparatus is assembled to be a movable part in the vertical direction, whereby after the combining section of the post processing apparatus is adjusted to the combining section of the image forming apparatus, both of the combining sections are secured to each other by the screws.

On the other hand, in recent years, speeded up operation and fined image formation are required to the image forming apparatus, and more speeded up operation is also required to the post processing apparatus. However, during binding operation, hole-punching operation, and folding operation, mechanical vibration and impact are adversely generated, wherein the impact is specifically and greatly generated during the binding operation. Further, due to the speeding up of the image forming apparatus, the number of the recording sheets to be processed becomes greater, the more impact is generated.

If the image forming apparatus and the post processing apparatus, disclosed in Unexamined Japanese Patent Application Publication No. 2002-128369, are combined, most of the vibration and the impact, generated in the post processing operation of the post processing apparatus, reach the image forming apparatus, which result in the reduction of an image reading accuracy.

To overcome this problem, a technology is disclosed in that a vibration control member is sandwiched between an image reading section of the image forming apparatus and an image forming section, integrally combined with the post processing apparatus (see Unexamined Japanese Patent Application Publication No. 2008-141304).

However, according to the technology of the latter Patent Application, the vibration and the impact, generated by the post processing apparatus, directly reach the image forming section, and since the image reading section has been mounted on the image forming section, when a bundle of a large number of recording sheets are to be finished, the image reading section adversely receives no small effect, though the vibration control member has been used. Further, if the vibration control member is mounted in the vertical direction, the weight of image reading section and a document feeding device, both mounted on the vibration control member, compresses the vibration control section, which results in the reduced effect of the vibration control member. Still further, based on the difference of the weight of units to be mounted on the vibration control member, the effect of the vibration control member changes, so that the units to be mounted are limited, which is a major problem.

SUMMARY OF THE INVENTION

One aspect of a post processing apparatus relating to the present invention is an apparatus to be placed on a floor, wherein the post processing apparatus is placed next to a downstream side of an image forming apparatus, also placed on the floor in a sheet conveyance direction, so that the post processing apparatus performs a post processing operation onto the sheets ejected from the image forming apparatus, wherein the post processing apparatus includes a plurality of joining sections, to join the image forming apparatus, and the plurality of the joining sections include an elastic member.

Further, another aspect of an image forming system relating to the present invention includes:

an image forming apparatus, to form an image on a recording sheet, and to be placed on a floor; and a post processing apparatus, which is installed at a downstream side of the image forming apparatus with respect to the recording sheet conveyance direction, to perform a post processing operation onto the recording sheet to be ejected from the image forming apparatus, wherein a plurality of joining sections connect the image forming apparatus and the post processing apparatus, and the plurality of the joining sections include an elastic member.

BRIEF DESCRIPTION OF THE DRAWINGS

Embodiment will now be described, by way of example only, with reference to the accompanying drawings which are meant to be exemplary, not limiting, and wherein like elements are numbered alike in the several figures, in which.

DETAILED DESCRIPTION OF THE PREFERRED EMBODIMENT

The present invention will now be detailed, while referring to an embodiment shown in the figures, but the present invention is not limited to the embodiment detailed below.

Figure 1:
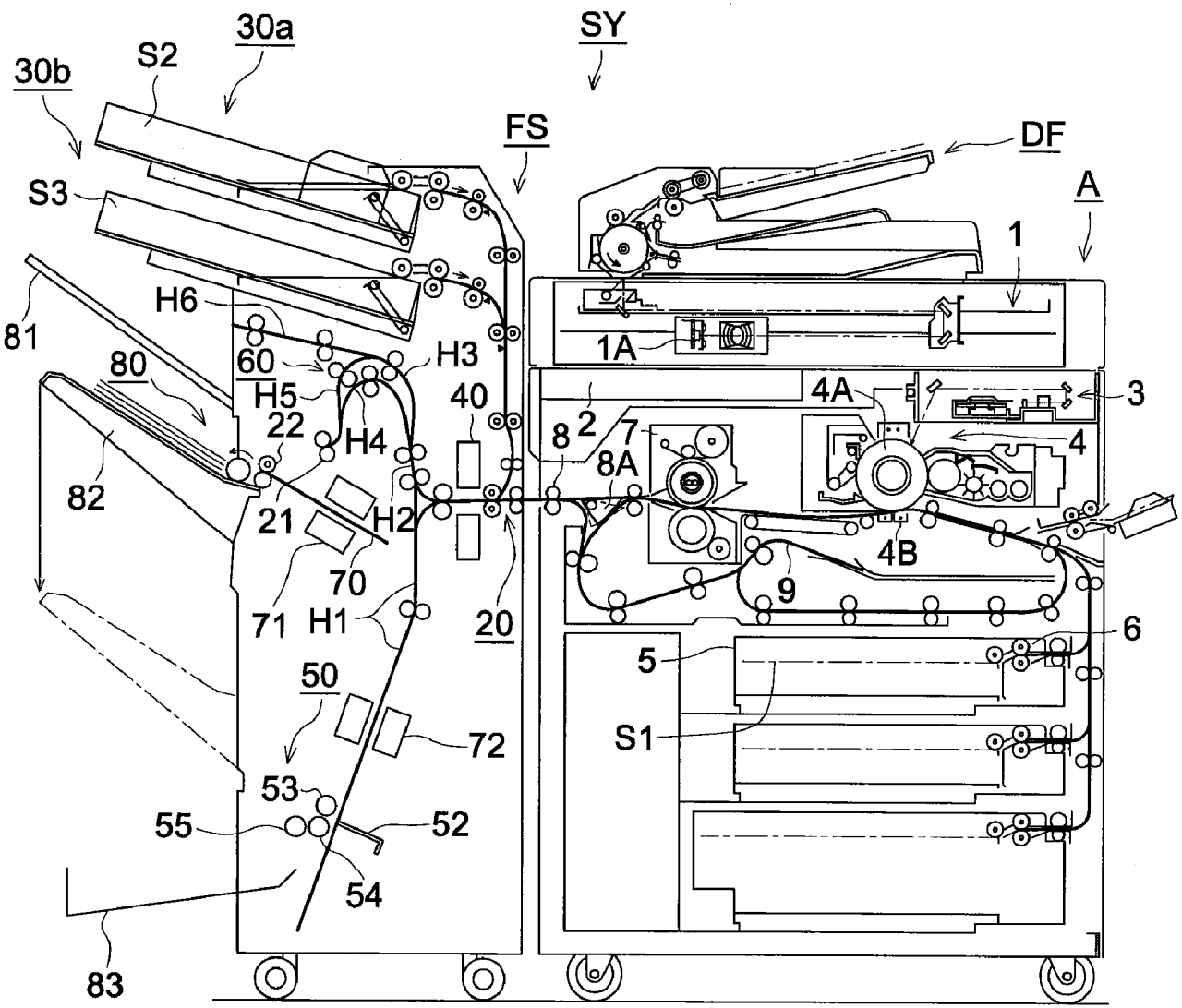
FIG. 1 is a total schematic drawing of image forming system SY, relating to the present invention.

FIG. 1 is the total schematic drawing of image forming system SY, relating to the present invention. Image forming system SY of the present invention includes image forming apparatus "A" to be placed on the floor, and post processing apparatus FS, combined to the downstream side of image forming apparatus "A", also placed on the floor with respect to the sheet conveyance direction, so that post processing apparatus FS performs the post processing operation onto the plurality of the recording sheets ejected from image forming apparatus "A". Automatic document feeding device DF is mounted on image forming apparatus "A", and post processing apparatus FS is combined to the downstream side of image forming apparatus "A".

[General Description of Image Forming Apparatus "A"]

Image forming apparatus "A" is structured of image reading section 1, image processing section 2, image writing section 3, image forming section 4, sheet supplying cassette 5, sheet supplying section 6, image fixing section 7, sheet ejection section 8, automatic double surfaces supplying section 9, and the like. An original document, placed on a platen of automatic document feeding device DF, is conveyed in an arrowed direction, and images, carried on the front surface or both surfaces of the original document, are read by an optical system of image reading section 1, and read into CCD image sensor 1A. Analog signals, photo-electrically converted by CCD image sensor 1A, are conducted with regard to various processes, such as an analog process, a A/D conversion, a shading correction, and an image compressing process by, image processing section 2. After that said processed signals are sent to image writing section 3.

To form latent images on photo conductive drum 4A, laser rays are emitted from a semiconductor laser generation device of image writing section 3 to scan the images carried on the original document, whereby the laser rays, reflected from the scanned images, are focused on photoconductive drum 4A, and form the latent images. On image forming section 4, after the latent images are electrically charged, said images are developed, whereby toner images are formed on photoconductive drum 4A.

Recording sheet S1, supplied from sheet supplying cassette by sheet supplying section 6, comes into contact with photoconductive drum 4A, whereby the toner images are transferred onto recording sheet S1. Recording sheet S1, carrying the transferred toner images, is permanently fixed by image fixing section 7, and said recording sheet is conveyed to post processing apparatus FS through sheet ejection section 8.

When the images are formed on both surfaces of the recording sheet S1, recording sheet S1, having passed through image fixing section 7, is conveyed to automatic double surfaces supplying section 9, by conveyance route switching plate 8*a*. After that, the toner images are transferred onto the back surface of the recording sheet S1 by image forming section 4, where said transferred images are permanently fixed by image fixing section 7, and recording sheet S1, carrying the fixed images on its both surfaces, is conveyed to post processing apparatus FS through sheet ejection section 8.

[General Description of Post Processing Apparatus FS]

Post processing apparatus FS is structured of recording sheet entrance section 20, insertion sheet supplying sections 30*a* and 30*b*, hole-punching section 40, sheet folding section 50, sheet superposing section 60, sheet binding sections 71 and 72, and ejected sheet alignment section 80.

Insertion sheets S2 are stored in insertion sheet supplying section 30*a*, while insertion sheets S3, being different from insertion sheets S2, are stored in insertion sheet supplying section 30*b*. Insertion sheets S2 and S3 represent cover sheets or insertion sheets, which are inserted between the plurality of recording sheets S1, ejected from image forming apparatus "A", and said sheets S2 and S3 are able to be hole-punched or folded, in the same way as in the case of recording sheets S1. Insertion sheets S2 and S3, conveyed from insertion sheet supplying sections 30*a* and 30*b*, are subsequently forward downward, and conveyed to sheet entrance section 20 through a conveyance route forwarding downward. In the following explanations, recording sheet S1, and insertion sheets S2 and S3, are together referred to as sheet S.

Hole-punching section 40 is provided on sheet entrance section 20, and sheet folding section 50 is provided on conveyance route H1, branched downward from sheet entrance section 20.

Sheet superposing section 60 is provided on the downstream side of conveyance route H2, branched upward from sheet entrance section 20, and said section 60 incorporates conveyance route H3, H4 and H5. Through conveyance routes H3, H4 and H5, superposed sheets S, being two sheets, can be conveyed to stacking section 70, which is provided downstream of routes H3, H4 and H5. After previously determined number of sheets S have been stacked on stacking section 70, binding section 71 is activated to bind stacked sheets S. Bound sheets S are subsequently ejected to elevating tray 82.

When the folding process is to be conducted onto sheet S, after sheet S has been conveyed downward from sheet entrance section 20 to conveyance route H1, sheet S is folded in two or three by sheet folding section 50, and ejected to sheet tray 83 (being an ejection tray).

When a saddle stitching process is to be conducted onto sheets S, after sheets S have been conveyed downward from sheet entrance section 20 to conveyance route H1, sheets S are stitched by sheet binding section 72, and folded at their centers, after that, they are ejected to sheet tray 83.

[Joining Section]

Figure 2:
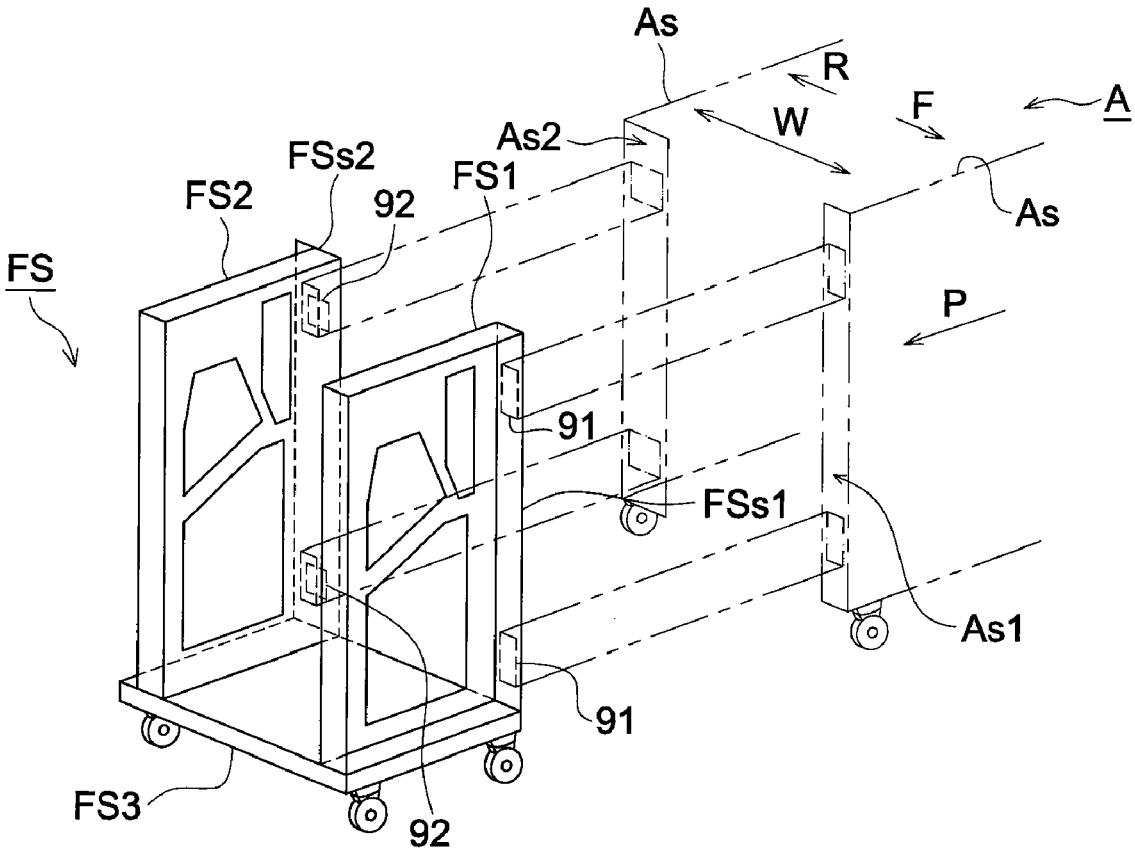
FIG. 2 is a schematic structural drawing, to detail the structure of the joining section, relating to the present invention.

FIG. 2 is a schematic structural drawing to detail the structure of the joining section, relating to the present invention.

In FIG. 2, symbol P represents the direction of the sheet conveyance, and symbol W represents the direction across the width of sheet S, being perpendicular to said sheet conveyance direction P. Further, arrow F represents a left direction, viewed in sheet conveyance direction P, so that arrow F is directed to the front side. Arrow R represents a right direction, viewed in sheet conveyance direction P, so that arrow R is directed to the rear side.

The plurality of joining sections relating to the present invention are provided on the left side and the right side across the sheet width, being perpendicular to the sheet conveyance direction. Combining mechanism 91 is mounted on front side F, while combining mechanism 92 is mounted on rear side R. In FIG. 2, symbol FS1 represents a front plate of post processing apparatus FS, symbol FS2 represents a rear plate, and symbol FS3 represents a bottom plate. That is, front plate FS1, rear plate FS2, and bottom plate FS3 structure a housing (its reference symbol is not shown) of post processing apparatus FS. Further, symbol As shows a housing of image forming apparatus "A". Symbol As1 represents a combining surface (serving for the front side) of housing As of image forming apparatus "A", wherein combining surface As1 faces post processing apparatus FS. Symbol As2 represents a combining surface (serving for the rear side) of housing As of image forming apparatus "A", wherein combining surface As2 faces post processing apparatus FS. Still further, symbol FSs1 represents a combining surface (being the front side) to mount the combining mechanism (being the front side), wherein combining surface FSs1 faces image forming apparatus "A". Symbol FSs2 represents a combining surface (being the rear side) to mount the combining mechanism (being the rear side). Casters (having no reference symbols) are mounted on bottom plate FS3, so that post processing apparatus FS can be moved easily on the floor.

Combining mechanism (serving for the front side) 91 is configured to be mounted on post processing apparatus FS, so that combining mechanism 91 combines combining surface (serving for the front side) FSs1 of front plate (serving for the front side) FS1, and combining surface (serving for the front side) As1 of housing As of image forming apparatus "A", whereby combining mechanism 91 determines the position of post processing apparatus FS against image forming apparatus "A" with respect to the sheet width direction, to mechanically secure both apparatuses "A" and FS. Further, simultaneously, combining mechanism 92 determines the position of post processing apparatus FS against image forming apparatus "A", with respect to the sheet conveyance direction, to mechanically secure both apparatuses "A" and FS, as well as secures the position with respect to the height direction. In the same way as in the above, combining mechanism (serving for the rear side) 92 is configured to be mounted on post processing apparatus FS, so that combining mechanism 92 combines combining surface (serving for the rear side) FSs2 of rear plate (serving for the rear side) FS2, and combining surface (serving for the rear side) As2 of housing As, whereby combining mechanism 92 determines the position of post processing apparatus FS against image forming apparatus "A", with respect to the sheet width direction, to mechanically secure both apparatuses "A" and FS.

Figure 3A:
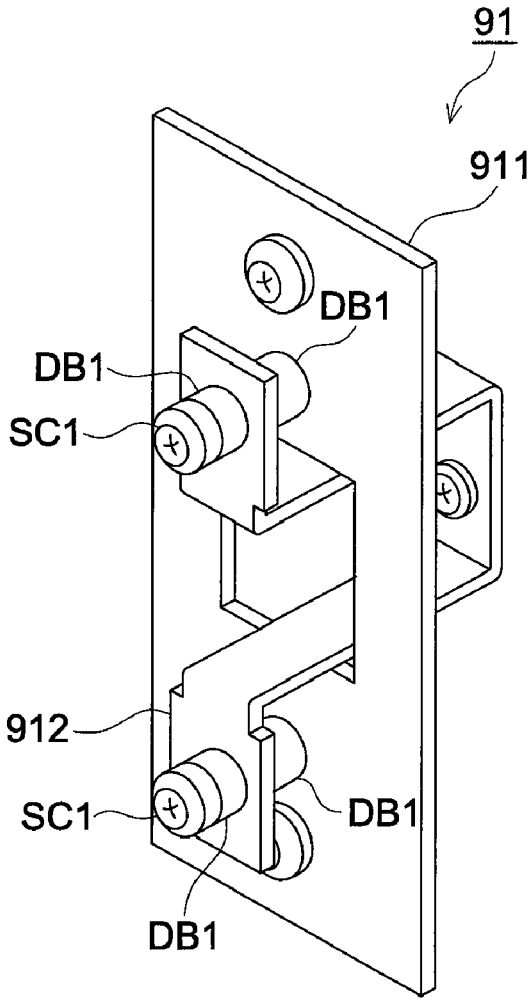
FIGS. 3*a* and 3*b* are schematic structural drawings, to detail the structure of mechanical joining section 91 (being a front side), relating to the present invention.
Figure 3B:
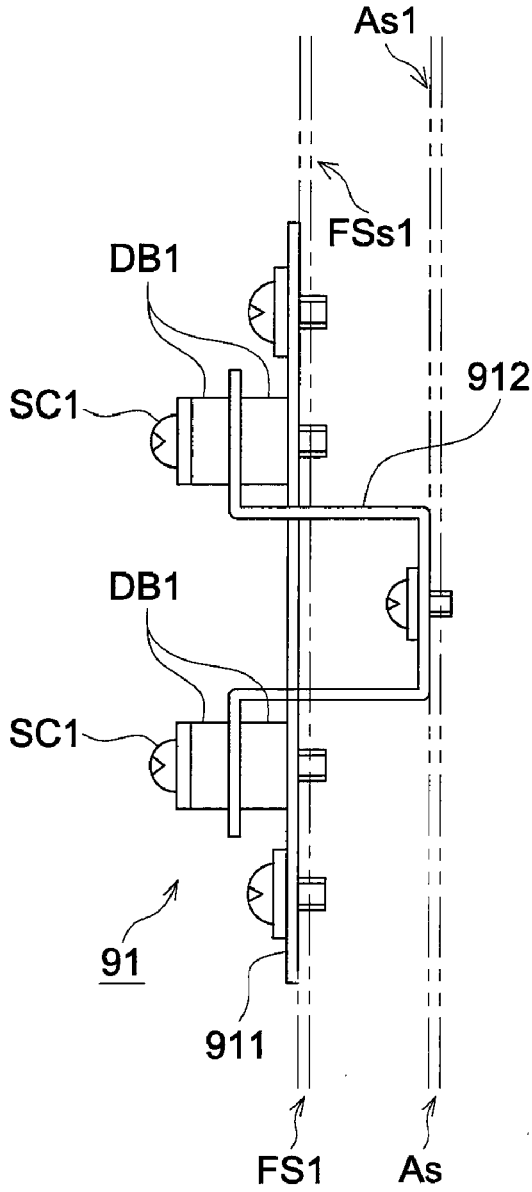

FIGS. 3*a* and 3*b* are schematic structural drawings, to detail the structure of mechanical joining section (serving for the front side) 91, relating to the present invention.

Mechanical joining section (serving for the front side) 91 is structured of two securing members (serving for the front side) 911 to be mounted on front plate FS1 of post processing apparatus FS, two vibration absorbing members (serving for the front side) 912 to be mounted on housing As of image forming apparatus "A", a plurality of elastic members DB1, and a plurality of setting screws SC1.

The assembling procedure of mechanical joining section (serving for the front side) 91 will be detailed below. Firstly, securing members (serving for the front side) 911 and vibration absorbing members (serving for the front side) 912 are connected by elastic members DB1 and setting screws SC1. The structures of elastic member DB1 and setting screw SC1 will be detailed while referring to FIG. 5. Secondly, two securing members 911 connected to two vibration absorbing members 912 are mounted on an upper portion and a lower portion of a back surface of combining surface (being the front side) FSs1, respectively. After mechanical joining section 92 has been connected to post processing apparatus FS (which will be detailed later), post processing apparatus FS is installed at a predetermined position (which will also be detailed later). After that, post processing apparatus FS is combined to image forming apparatus "A".

Figure 4A:
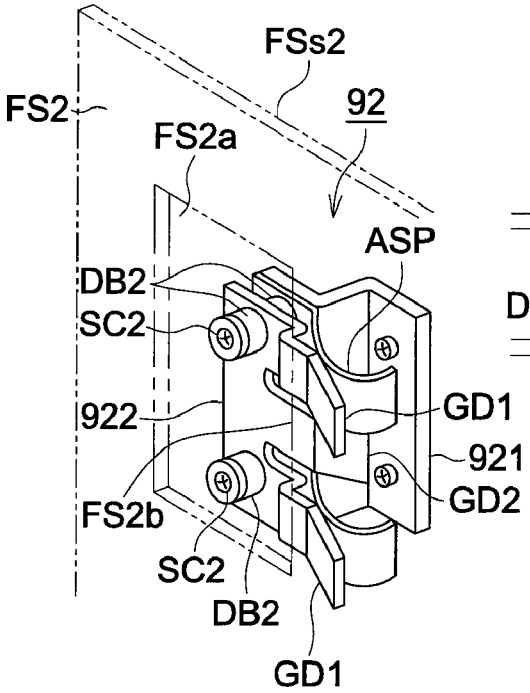
FIGS. 4*a* and 4*b* are schematic structural drawings, to detail the structure of mechanical joining section 92 (being a rear side), relating to the present invention.
Figure 4B:
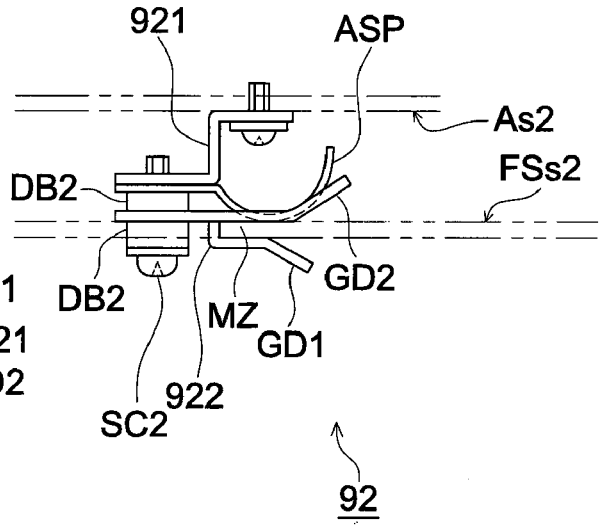

FIGS. 4*a* and 4*b* are schematic structural drawings, to detail the structure of mechanical joining section 92 (serving for the rear side), relating to the present invention.

In FIGS. 4*a* and 4*b*, mechanical joining section (serving for the rear side) 92 is structured of securing member (serving for the rear side) 921 to be mounted on rear plate FS2, vibration absorbing member (serving for the rear side) 922 to be mounted on housing As, ground plate ASP serving as a ground member, elastic member DB2, and a plurality of setting screws SC2. Vibration absorbing member (serving for the rear side) 922 includes guide members GD1 and GD2, both forming groove MZ, so that two securing sides FS2*b* of rear plate FS2 are guided by guide members GD1 and GD2, and inserted in groove MZ.

The assembling procedure of mechanical joining section (serving for the rear side) 92 will be detailed below. Firstly, securing members (serving for the rear side) 921, vibration absorbing members (serving for the rear side) 922, and ground plate ASP are secured by setting screws SC2 inserted through elastic member DB2. The structures of elastic member DB2 and setting screw SC1 will be detailed later while referring to FIG. 5.

Secondly, securing member (serving for the rear side) 921 are mounted on combining surface (serving for the rear side) As2 of housing As, after that, mechanical joining section (serving for the rear side) 92 is inserted in open section FS2*a* of rear plate FS2, and securing side FS2*b*, being the side of open section FS2*a*, is inserted in groove section MZ of vibration absorbing member 922. Finally, vibration absorbing member (serving for the front side) 912 of mechanical joining section (serving for the front side) 91 is secured on combining surface (serving for the rear side) As1 of housing As, whereby image forming apparatus "A" and post processing apparatus FS are aligned at a predetermined position.

The predetermined position, described above, represents a position where sheet S1 ejected from sheet ejection section 8 of image forming apparatus "A" matches sheet S1 to be introduced in sheet entrance section 20 of post processing apparatus FS. That is, position determining work aiming at the predetermined position, with respect to sheet width direction W and the height direction of post processing apparatus comparing with image forming apparatus "A", is conducted when mechanical parts having improved accuracy are used, which parts are to be used when vibration absorbing member (serving as the front side) 912 is mounted on housing As. Further, to determine the position in the sheet conveyance direction, the predetermined position is obtained, when securing side FS2*b* of post processing apparatus FS is inserted in groove section MZ of vibration absorbing member (serving for the rear side) 922. Based on the above position determination, sheet S1 can be correlatively conveyed from image forming apparatus "A" to post processing apparatus FS.

Mechanical joining section (serving for the front side) 91 and mechanical joining section (serving for the rear side) 92, both being joining sections of the present invention, are mounted on two positions across the sheet width, and each section is secured in sheet conveyance direction P. Accordingly, even if the floor is inclined, any separation, occurred at the joining section between post processing apparatus and image forming apparatus "A", can be controlled.

Ground plate ASP is, for example, formed of a phosphor bronze used for the spring, exhibiting an elastic nature and a conductive property. Ground plate ASP may be provided on either one of two mechanical joining sections (serving for the rear side) 92, and on at least one of two mechanical joining sections (serving for the front side) 91.

Figure 5A:
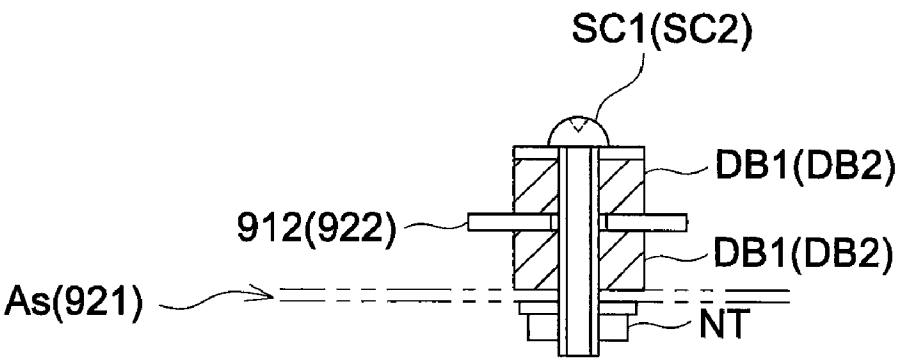
FIGS. 5*a*, 5*b*, and 5*c* are cross sectional views, to show mounting structures to mount elastic members DB1 and DB2, to be used for mechanical joining section 91 (being a front side), and mechanical joining section 92 (being a rear side).
Figure 5B:
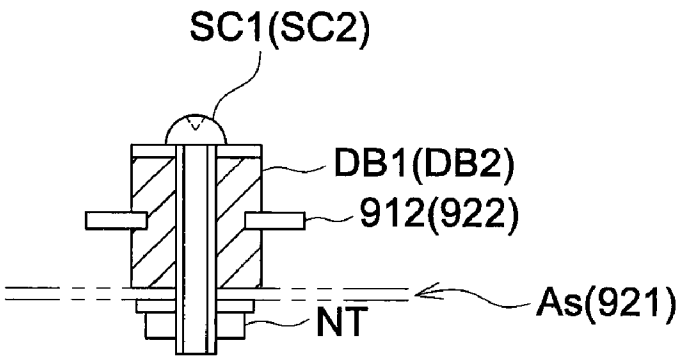
Figure 5C:
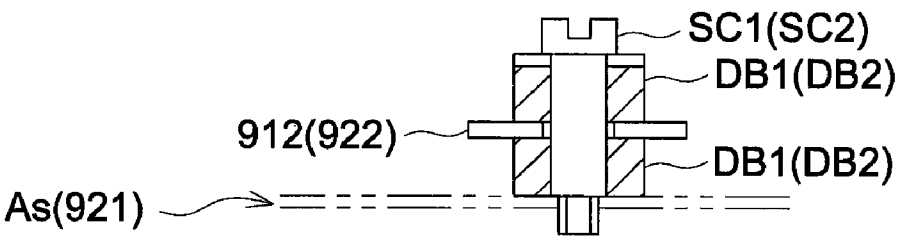

FIGS. 5*a*, 5*b*, and 5*c* are the cross sectional views, to show the structures to mount elastic members DB1 and DB2, to be used for mechanical joining section (serving for the front side) 91, and mechanical joining section (serving for the rear side) 92.

FIG. 5*a* shows a method to secure two elastic members DB1 or DB2 with a single screw SC1 or SC2, FIG. 5*b* shows a method to secure a single elastic member DB1 or DB2 with a single screw SC1 or SC2, wherein securing work is conducted by screwing nut NT. FIG. 5*c* shows a method to secure two elastic members DB1 or DB2 with stepped screws SC1 or SC2. As not illustrated, a single elastic member DB1 or DB2 is, as a matter of course, secured by stepped screw SC1 or SC2.

Since mechanical joining section (serving as the front side) 91 and mechanical joining section (serving as the rear side) 92 have been used in the present embodiment, the correct positional adjustment between both apparatuses can be conducted easily. Further, elastic members DB1 and DB2 have been applied onto both mechanical joining section (serving as the front side) 91 and mechanical joining section (serving as the rear side) 92, any vibration and impact, generated by post processing apparatus FS, are prevented from being transmitted to image forming apparatus "A".

Further, since ground plate ASP has been mounted on mechanical joining section (serving for the front side) 92, other grounding sections are not required to be used, whereby, the apparatuses can be easily grounded by the simple structure as detailed above, which results in the reduction of the manufacturing cost.

In the present embodiment, mechanical joining section (serving as the front side) 91 has been mounted on the front side, and mechanical joining section (serving as the rear side) 92 has been provided on the rear side. However, both sections 91 and 92 can be mounted, after being changed to each other, concerning the front side and the rear side. Still further, mechanical joining section (serving as the front side) 91, and mechanical joining section (serving as the rear side) 92 have been mounted on two positions, respectively, either one of sections 91 and 92 can be mounted on a single position.

Concerning the effect of the invention, based on the post processing apparatus and the image forming system, of the present embodiment, the image forming apparatus and the post processing apparatus can be accurately combined and installed. Further, since the post processing apparatus and the image forming apparatus are installed on the floor, any vibration and impact in the vertical direction, generated by the post processing apparatus, do not transmit to the image forming apparatus, and any vibration and impact in the horizontal direction are absorbed by the elastic members. Accordingly, even if a large number of stacked sheets are post-finished, the image forming apparatus does not adversely reduce the image reading accuracy. Still further, though the elastic member is configured to be inserted between the image forming apparatus and the post processing apparatus, both apparatuses can be installed simply.

What is claimed is:

1. A post processing apparatus placed on a floor next to an image forming apparatus also placed on the floor on a downstream side of the image forming apparatus with respect to a sheet conveyance direction, the post processing apparatus performing a post processing operation on sheets ejected from the image forming apparatus, and the post processing apparatus comprising:

a plurality of joining sections by which the post processing apparatus is joinable to the image forming apparatus;

wherein:

each of the plurality of joining sections includes an elastic member;

the plurality of joining sections include a first joining section and a second joining section individually provided on right and left sides, respectively, of the post processing apparatus in a sheet width direction perpendicular to the sheet conveyance direction when viewed in the sheet conveyance direction;

the first joining section determines a first position at which the image forming apparatus is joined to the post processing apparatus and which is adjustable in the sheet width direction and in the sheet conveyance direction; and the second joining section determines a second position at which the image forming apparatus is joined to the post processing apparatus and which is adjustable in the sheet conveyance direction.

2. The post processing apparatus of claim 1, wherein at least one of the plurality of the joining sections includes a ground member to electrically connect the image forming apparatus to a ground.

3. An image forming system, comprising:

an image forming apparatus, which is placed on a floor and which forms an image on a sheet;

a post processing apparatus, which is placed on the floor and installed next to the image forming apparatus on a downstream side thereof in a sheet conveyance direction, the post processing apparatus performing a post processing operation on sheets ejected from the image forming apparatus; and a plurality of joining sections by which the post processing apparatus is joinable to the image forming apparatus;

wherein:

each of the plurality of joining sections includes an elastic member;

the plurality of joining sections include a first joining section and a second joining section individually provided on right and left sides, respectively, of the post processing apparatus in a sheet width direction perpendicular to the sheet conveyance direction when viewed in the sheet conveyance direction;

the first joining section determines a first position at which the image forming apparatus is joined to the post processing apparatus and which is adjustable in the sheet width direction and in the sheet conveyance direction; and the second joining section determines a second position at which the image forming apparatus is joined to the post processing apparatus and which is adjustable in the sheet conveyance direction.

4. The image forming system of claim 3, wherein at least one of the plurality of the joining sections includes a ground member to electrically connect the image forming apparatus to a ground.

* * * * *